US008079474B1

(12) United States Patent
Flaming

(10) Patent No.: US 8,079,474 B1
(45) Date of Patent: Dec. 20, 2011

(54) STACKABLE CONTAINER AND METHOD FOR MAKING THE SAME

(75) Inventor: Max Flaming, Fresno, CA (US)

(73) Assignee: Maxco Supply, Inc., Parlier, CA (US)

( * ) Notice: Subject to any disclaimer, the term of this patent is extended or adjusted under 35 U.S.C. 154(b) by 588 days.

(21) Appl. No.: 12/183,016

(22) Filed: Jul. 30, 2008

Related U.S. Application Data

(60) Provisional application No. 60/952,812, filed on Jul. 30, 2007.

(51) Int. Cl.
*B65D 85/62* (2006.01)

(52) U.S. Cl. ..... 206/509; 206/501; 206/511; 229/915; 229/919

(58) Field of Classification Search ..... 229/165, 229/916, 918, 120, 191, 915, 919, 119; 206/509, 206/501, 511; 220/62, 62.1
See application file for complete search history.

(56) References Cited

U.S. PATENT DOCUMENTS 4,905,834 A 3/1990 Mur Gimeno et al.
5,860,590 A 1/1999 Blomfield et al.
6,604,675 B2 * 8/2003 Southwell ..... 229/164
6,641,032 B1 11/2003 Schilling
2002/0125308 A1 9/2002 McLeod
* cited by examiner

*Primary Examiner* — Mickey Yu
*Assistant Examiner* — Kareen Rush
(74) *Attorney, Agent, or Firm* — The Law Offices of Andrew D. Fortney; Andrew D. Fortney; Sherrie M. Flynn

(57) ABSTRACT

A stackable container and blanks for forming a stackable container are disclosed. In one embodiment, a stackable container has (a) a base having two pairs of opposed base edges, (b) two first sidewall structures foldably attached to the first base edges at an angle of from about 90 degrees to about 100 degrees, and (c) two second sidewall structures. The second sidewall structures generally each include (i) a wall flap foldably attached to one of the base edges at an angle of from about 90 degrees to about 100 degrees, (ii) an index fold-down flap foldably attached to the wall flap at an angle of about 180 degrees, and (iii) a plurality of inner fold-down flaps foldably attached to the wall flap at an angle of about 180 degrees. Embodiments of the present invention can advantageously provide a reliable design approach for making a stackable container from a blank, whereby the weight-bearing ability and/or stackability of the container is improved, while also covering flutes on the load-bearing wall, thereby reducing moisture collection.

34 Claims, 4 Drawing Sheets

(Background)

(Background)

STACKABLE CONTAINER AND METHOD FOR MAKING THE SAME

CROSS REFERENCE TO RELATED APPLICATIONS

This application claims the benefit of U.S. Provisional Patent Application No. 60/952,812, filed Jul. 30, 2007 (Attorney Docket No. MAX-004PR), incorporated herein by reference in its entirety.

FIELD OF THE INVENTION

The present invention generally relates to the field of containers. More specifically, embodiments of the present invention pertain to methods and structures for forming a stackable container.

DISCUSSION OF THE BACKGROUND

In many areas of commerce, containers and, in particular, stackable containers are used to hold and/or transport products. For the area of produce (e.g., fresh fruits and vegetables), such stackable containers are particularly important. In various conventional approaches (see, e.g., U.S. Pat. No. 5,860,590 and U.S. patent application Ser. No. 11/246,872, filed on Oct. 7, 2005), a stackable container is formed from a container blank. The weight-bearing walls of a container may conventionally include two wall flaps, one folded over the other. For example, referring now to FIGS. 1 and 2, a container blank 100 and an erected stackable container 110 are shown. Load bearing wall 111 of container 110 may be formed by folding wall flap 101 of blank 100 over wall flap 102 at bridge regions 103, thus forming projections 113. Thus, projections 113 are covered by the outer surface of the container blank. Furthermore, the rectangular base 106 and/or the side wall 102 may have holes cut in them to receive the upwardly directed projections 115 from a lower container in the stack. Thus, the holes and projections allow a stack of containers to be indexed such that they stack vertically.

Conventional packaging containers are typically formed from blanks made of corrugated board. Such corrugated board generally contains two outer layers of paperboard or cardboard (which generally has a relatively heavy weight), with an inner layer of corrugation (e.g., corrugated paper), but it may contain further layers (e.g., of an external paper or plastic sheet for further support, waterproofing and/or marking, e.g., with advertising and/or identification information; a further inner layer or sheet [e.g., of paper or plastic] between two layers of corrugation; etc.) or contain different materials (e.g., plastic sheet having a relatively high stiffness or modulus of elasticity). Conventionally, packaging containers are formed such that the "flutes," or channels formed by the corrugation, are directed upward in the load bearing walls. Thus, referring again to FIG. 2, when indexing projections 113 are formed by folding flap 101 over flap 102 at bridge region 103, the areas 112 between the projections comprise uncovered flutes. As a result, moisture may collect in these flutes due to outdoor precipitation, condensation in cold storage, and/or other natural and/or unnatural events. This moisture in the flutes may weaken the container over time.

Therefore it is desirable to provide a container with good stackability (including indexing and relatively high load strength) while reducing degradation due to moisture collection.

SUMMARY OF THE INVENTION

Embodiments of the present invention relate to stackable container blanks, stackable container structures, and methods for forming stackable container structures (e.g., by folding blanks).

In one embodiment, the invention relates to a stackable container blank having (a) a base having a first pair of opposed base edges (typically, but not necessarily, shorter base edges) and a second pair of opposed base edges (typically, but not necessarily, longer base edges), (b) two first sidewall structures, each first sidewall structure foldably attached to one of the first base edges, and (c) two second sidewall structures, each second sidewall structure foldably attached to one of the second base edges. Each of the second sidewall structures (e.g., structures on the longer sides) has (i) a wall flap foldably attached to one of the second base edges along a first fold line, (ii) an index fold-down flap foldably attached to the wall flap along a second fold line, and (iii) a plurality of inner fold-down flaps foldably attached to the wall flap along a third fold line, wherein the index flap and inner fold-down flaps alternate. It will be recognized that either the first two opposing sides or the second two opposing sides may be longer, or the first two opposing sides and the second two opposing sides may be substantially equal in length (thus forming a square), but preferably the second two opposing sides are longer.

In some embodiments, the wall flap includes one or more holes configured to provide slots for indexing with another stackable container. The wall flap and the index fold-down flap form index projections configured to fit into the slots. In preferred embodiments, each second sidewall structure has two index flaps (thus forming two index projections on each of the two sides) and three inner fold-down flaps, where inner fold down flaps and index flaps alternate along the wall flap. In other embodiments (e.g., where the second sidewall structure is on a shorter side), each second sidewall structure has one index fold-down flap and two inner fold-down flaps, where the index fold-down flap is between the two inner fold-down flaps.

In other embodiments, the wall flap and/or one or more of the inner fold-down flaps have one or more holes configured to provide an opening for air flow. The width at the top of the holes may be greater than the width of the bottom of the holes (e.g., the holes may have a generally triangular shape with an apex nearest the fold line between the index flap and the fold-down flap).

The fold lines between the wall flap and the index and inner wall flaps (e.g., the second and third fold lines) are generally parallel to the fold line between the second sidewall structure and the base (e.g., the first fold line). In preferred embodiments, the distance between the first fold line and the second fold line is greater than the distance between the first fold line and the third fold line. Thus, when the index fold-down flaps are folded over the wall flap, they form a projection above the fold line of the inner fold-down flaps. In a further embodiment, the width of the inner fold-down flap is substantially equal to a width of the wall flap (e.g., excluding the height of the projection formed by the index fold-down flap). In another embodiment, an edge of the index fold-down flap and an edge of one of the inner fold-down flaps are separated by a cut-line in the blank. Thus, when the inner fold-down flaps alternate with index flaps, each index fold-down flap may be separated from its neighboring inner fold-down flaps by such a cut-line.

In yet another embodiment, each of the second sidewall structures includes first extension flaps foldably attached to each of the inner fold-down flaps closest to the first sidewall structures (e.g., attached to the inner fold-down flaps at the end of the wall flaps), along first extension fold lines approximately parallel to the first base edges. Preferably, the second sidewall structures also include second extension flaps foldably attached to the wall flap at ends closest to the first sidewall structures, along second extension fold lines approximately parallel to the first base edges. The first and second extension flaps generally extend beyond lines formed by the first opposing sides of the base edges.

The invention also relates to a stackable container that includes (a) a base having a first pair of opposed base edges and a second pair of opposed base edges, (b) two first sidewall structures, each first sidewall structure foldably attached to the first base edges at an angle of from about 90 degrees to about 100 degrees, and (c) two second sidewall structures. The second sidewall structures generally include (i) a wall flap foldably attached to one of the second two opposing edges of the base along a first fold line at an angle of from about 90 degrees to about 100 degrees, (ii) an index fold-down flap foldably attached to the wall flap along a second fold line at an angle of about 180 degrees, and (iii) a plurality of inner fold-down flaps foldably attached to the wall flap along a third fold line at an angle of about 180 degrees.

The wall flaps and/or the base of the stackable container may include one or more holes configured to provide slots for indexing with another stackable container. Thus, each wall flap and the index fold-down flap form index projections configured to fit into the slots. In preferred embodiments, each second sidewall structure has two index flaps (thus forming two index projections on each of the two sides) and three inner fold-down flaps, where inner fold-down flaps and index fold-down flaps alternate along the wall flap.

In other embodiments, the wall flap and/or one or more of the inner fold-down flaps have one or more holes configured to provide an opening for air flow. In the erected container, holes in the inner fold-down flaps are generally aligned with complimentary holes in the wall flap such air flows through the sidewall structure when the inner fold-down flaps are folded over the wall flap.

The tops of the wall flaps (e.g., at the fold lines of the index and inner fold-down flaps) are generally parallel to the fold line between the second sidewall structure and the base (e.g., the first fold line). In preferred embodiments, the top of the wall flap at the fold line of the index fold-down flap(s) is higher than the top of the wall flap at the fold line of the inner fold-down flaps. Thus, the index fold-down flap is folded over the wall flap to form a projection above the top of the wall flap at the fold line of the inner fold-down flaps. In a further embodiment, the height of the inner fold-down flap is substantially equal to a height of the wall flap (e.g., excluding the height of the projection formed by the index fold-down flap). In another embodiment, a surface of one or more of the inner and/or index fold-down flaps is adhesively attached to a surface of the wall flap. Preferably, surfaces of each of the inner and index fold-down flaps are adhesively attached to a surface of the wall flap.

Each of the second sidewall structures may also include first extension flaps foldably attached at an angle of about 90 degrees to each of the inner fold-down flaps closest to the first sidewall structures, such that the first extension flaps are parallel to the first sidewall structures. They may further include second extension flaps foldably attached at an angle of about 90 degrees to the wall flap at ends closest to the first sidewall structures, such that the second extension flaps are parallel to the first extension flaps and to the sidewall structures. In one exemplary embodiment, a first surface of each of the second extension flaps is adhesively attached to a first surface (e.g., an inner surface) of one of the first sidewall structures and a surface of each of the first extension flaps is adhesively attached to a second surface of one of the second extension flaps.

In an alternative embodiment, a first surface of each of the second extension flaps is adhesively attached to a first surface (e.g., an outer surface) of one of the first sidewall structures and a surface of each of the first extension flaps is adhesively attached to a second surface (e.g., an inner surface) of one of the first sidewall structures, thus "sandwiching" each first sidewall structure between two extension flaps.

The invention further relates to a method of making a stackable container by folding a stackable container blank (e.g., a stackable container blank as described herein). The method includes steps of folding two opposing first sidewall structures to form angles of about 90 degrees to about 100 degrees with respect to a base of a stackable container blank, and folding two opposing second sidewall structures. Folding each of the two opposing sidewall structures includes steps of (i) folding the wall flap along the first fold line to form an angle of about 90 degrees to about 100 degrees with respect to the base, (ii) folding the inner fold-down flaps along the third fold line to form an angle of about 180 degrees with respect to the wall flap, and (iii) folding the index fold-down flap along the second fold line to form an angle of about 180 degrees with respect to the wall flap, such that the second fold line projects above the third fold line. In further embodiments, the method includes adhesively attaching surfaces of each of the inner and index fold-down flaps to a surface of the wall flap.

In a preferred embodiment, the method includes folding first extension flaps foldably attached to each of the inner fold-down flaps closest to the first sidewall structures at an angle of 90 degrees with respect to the inner fold-down flaps, such that the first extension flaps are approximately parallel to the first sidewall structures. The method may also include folding second extension flaps foldably attached to the wall flap at an edge closest to the first sidewall structures at an angle of 90 degrees with respect to the wall flap, such that the second extension flaps are approximately parallel to the first extension flaps and the first sidewall structures.

In a further embodiment, the method includes adhesively attaching a first surface of each the second extension flaps to a first surface of one of the first sidewall structures. The method may also include adhesively attaching a surface of each of the first extension flaps to a second surface of one of the second extension flaps (e.g., sandwiching each second extension flap between a first sidewall structure and a first extension flap). Alternatively, the method may include adhesively attaching a surface of each of the first extension flaps to a second surface of one of the first sidewall structures (e.g., sandwiching each second sidewall structure between first and second extension flaps).

Embodiments of the present invention can advantageously provide a reliable design approach for making a stackable container from a blank, whereby the weight-bearing ability and/or stackability of the container is improved, while also covering flutes on the load-bearing wall, thereby reducing moisture collection. These and other advantages of the present invention will become readily apparent from the detailed description of preferred embodiments below.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications, and equivalents that may be included within the spirit and scope of the invention as defined by the appended claims. Furthermore, in the following detailed description of the present invention, numerous specific details are set forth in order to provide a thorough understanding of the present invention. However, it will be readily apparent to one skilled in the art that the present invention may be practiced without these specific details.

Embodiments of the present invention can advantageously provide a reliable and simplified design approach for making a stackable container from a blank whereby the weight-bearing ability of the structure is improved. The invention, in its various aspects, will be explained in greater detail below with regard to exemplary embodiments.

An Exemplary Stackable Container Blank

Figure 3:
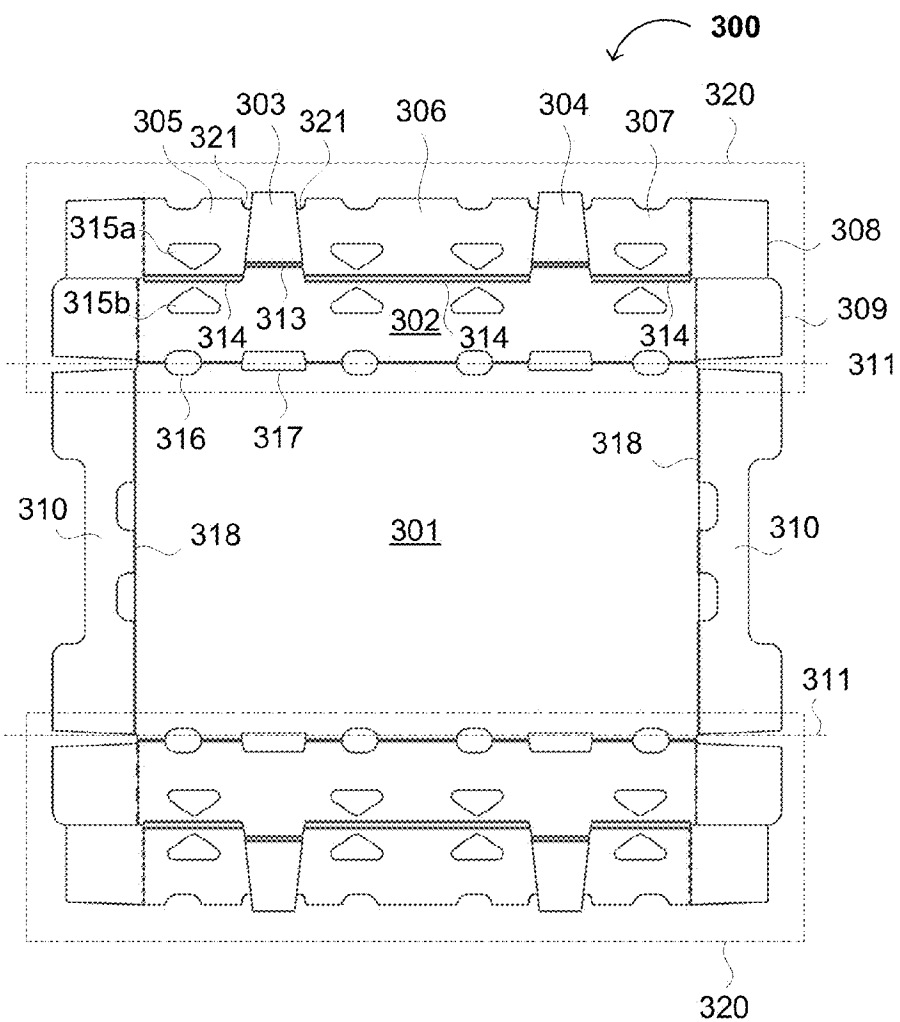
FIG. 3 is a diagram of a blank for a stackable container according to an embodiment of the present invention.

Referring now to FIG. 3, an exemplary blank 300 suitable for making a stackable container may have a base 301 having a first pair of opposed base edges 318 (typically, but not necessarily, shorter base edges) and a second pair of opposed base edges 311 (typically, but not necessarily, longer base edges). Although the exemplary blank 300 may be made from any material that can be cut, scored, folded, and assembled in the manner described herein, corrugated board is preferred. Such corrugated board generally contains two outer layers of paperboard or cardboard (which generally has a relatively heavy weight), with an inner layer of corrugation (e.g., corrugated paper), but it may contain further layers (e.g., of an external paper or plastic sheet for further support, waterproofing and/or marking, e.g., with advertising and/or identification information; a further inner layer or sheet [e.g., of paper or plastic] between two layers of corrugation; etc.) or contain different materials (e.g., plastic sheet having a relatively high stiffness or modulus of elasticity).

First sidewall structures 310 may each be foldably attached to one of the first base edges 318. Second sidewall structures 320 may each be foldably attached to one of the second base edges 311. A foldable attachment can be an attachment with a perforation, indentation, score, or other suitable form so as to facilitate a folding of one side of the attachment with respect to the other side of the attachment, while maintaining an attachment or connection between the two sides. For example, in FIG. 3, end walls 310 can be folded to approximately 90 degree angles with respect to base 301 to form walls of the stackable container structure, as will be discussed in more detail below.

Each of the second sidewall structures 320 has a wall flap 302 foldably attached to a base edge 311, index fold-down flaps 303 and 304 foldably attached to wall flap 302 along a fold line 313, and inner fold-down flaps 305, 306, and 307 foldably attached to wall flap 302 along a fold lines 314. The inner fold-down flaps 305-307 and the index fold-down flaps 303 and 304 alternate such that there is an index fold-down flap between each inner fold-down flap along wall flap 302. Wall flap 302 may include one or more holes 317 configured to provide slots for indexing with another stackable container. The wall flap 302 and the index fold-down flaps 303 and 304 form index projections configured to fit into the slots 317.

Preferably, the flutes (e.g., channels in the corrugation) are vertical in the load-bearing wall. In blank 300 second sidewall structures 320 may be folded to form the load-bearing wall. Thus, the flutes of the corrugated board forming the blank should be oriented perpendicularly to fold line 311. The fold lines between the wall flap and the index and inner wall flaps (e.g., the second and third fold lines) are generally parallel to the fold line between the second sidewall structure and the base (e.g., the first fold line). The distance between the first fold line 311 and the second fold line 313 (e.g., the height of the index tab) is greater than the distance between the first fold line 311 and the third fold lines 314 (e.g., the height of the folded sidewall). Thus, when the index fold-down flaps are folded over the wall flap, they form a projection above the fold line of the inner fold-down flaps.

In a further embodiment, the width of the inner fold-down flaps 305-307 is substantially equal to a width of the wall flap 302 (e.g., excluding the height of the projection formed by the index fold-down flap). The edge of the index fold-down flaps 303 and 304 and edges of inner fold-down flaps 305-307 are separated by cut-lines in the blank. Thus, when the inner fold-down flaps alternate with index flaps, each index fold-down flap may be separated from its neighboring inner fold-down flaps by such a cut-line.

Each of the second sidewall structures 320 also includes first extension flaps 308 foldably attached to each of the inner fold-down flaps 305 and 307 closest to the first sidewall structures, along first extension fold lines approximately parallel to the first base edges. Second extension flaps 309 are foldably attached to the wall flap 302 at ends closest to the first sidewall structures 310. The first and second extension flaps generally extend beyond lines formed by the base edges 318.

Sidewall structure 320 may have one or more holes 315*a* in inner fold-down flaps 305-307, and complementary holes 315*b* in wall flap 302. When inner fold-down flaps 305-307 are folded over wall flap 302, holes 315*a* and 315*b* may be configured to provide an opening for air to flow, for example. The width at the top of the holes may be less than the width of the bottom of the holes (e.g., the holes may have a generally triangular shape with an apex nearest the fold line between the wall flap and the inner fold-down flap). This triangular configuration generally provides for improved strength of the folded wall structure along fold lines 314 (e.g., as opposed to round or rectangular air holes in the same position).

Also included in exemplary stackable container blank 300 are indentations or cutouts 321. Cutouts 321 may substantially coincide with holes 317 when inner fold-down flaps 305-307 are folded onto wall flap 302. Cutouts 321 may facilitate index projections formed by wall flaps 302 and index fold-down flaps 303 and/or 304 from another stackable container sliding into holes or indexable slots 317 to form a stackable pair of containers, for example. In addition, blank 300 may include cutouts 316 along the foldable attachment between base 301 and wall flap 302. Such cutouts 316 may further assist air flow over produce within the assembled container and/or enable access to a lower surface of an overlying stacked container for ease in lifting (e.g., un-stacking) such stacked containers.

Figure 2:
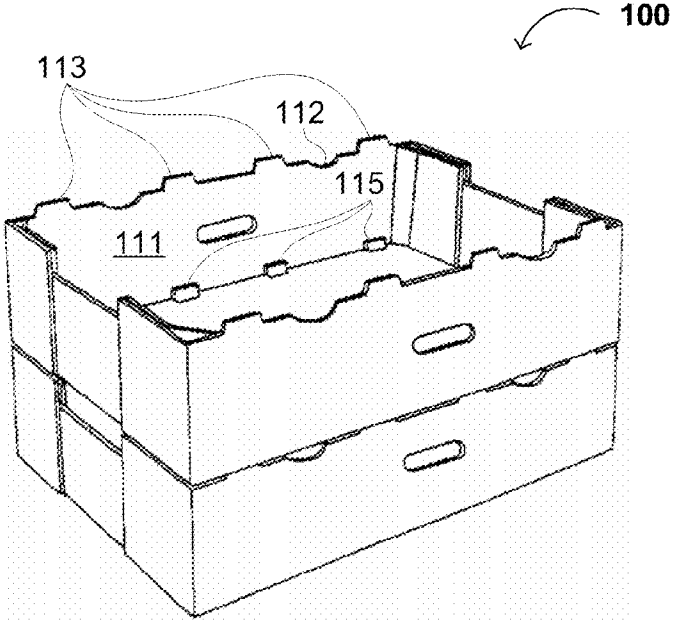
FIG. 2 is a diagram of a conventional stackable container.
Figure 1:
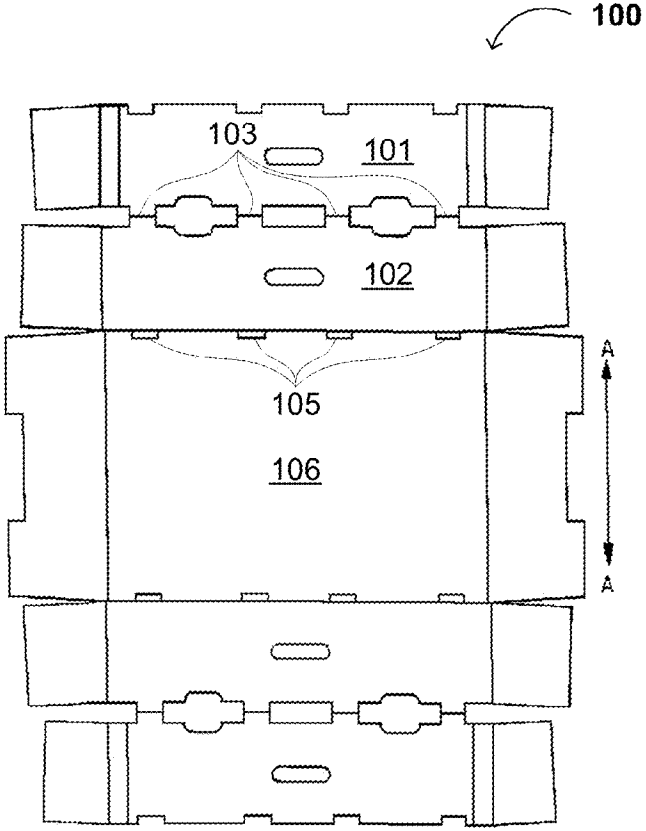
FIG. 1 is a diagram of an exemplary blank for a conventional stackable container.
Figure 4:
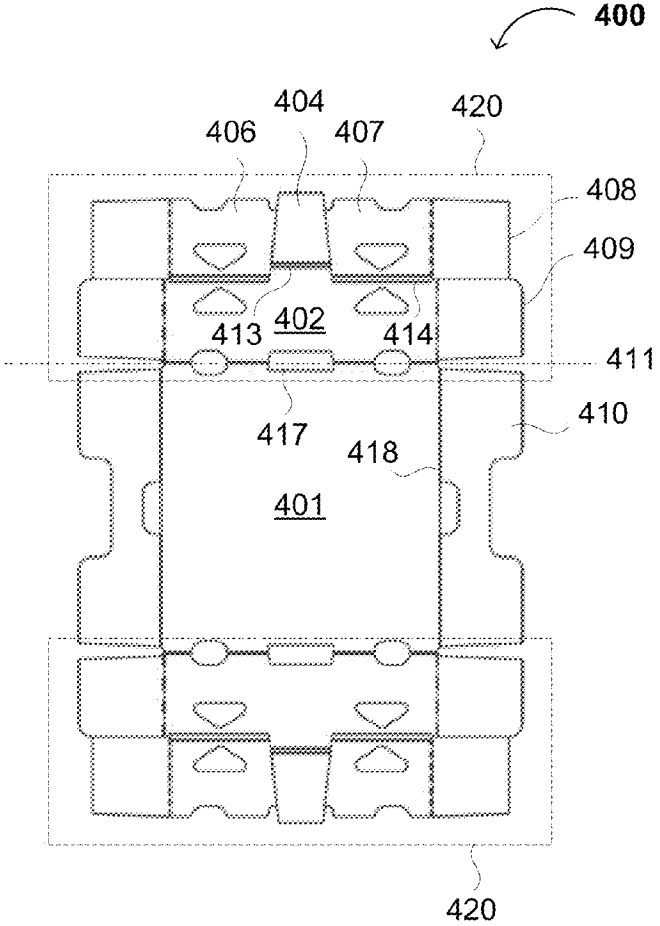
FIG. 4 is a diagram of a blank for a stackable container according to an alternative embodiment of the present invention.

In preferred embodiments, as shown in FIG. 3, each second sidewall structure 320 has two index flaps 303 and 304 (thus forming two index projections on each of the two sides) and three inner fold-down flaps 305-307, where inner fold down flaps and index flaps alternate along the wall flap 302. Referring now to FIG. 4, an alternative embodiment of a blank 400 is shown. Blank 400 includes base 401 and first sidewall structures 410, as well as second sidewall structures 420. In this embodiment, each second sidewall structure 420 has one index fold-down flap 404 between inner fold-down flaps 406 and 407.

An Exemplary Stackable Container

Figure 5:
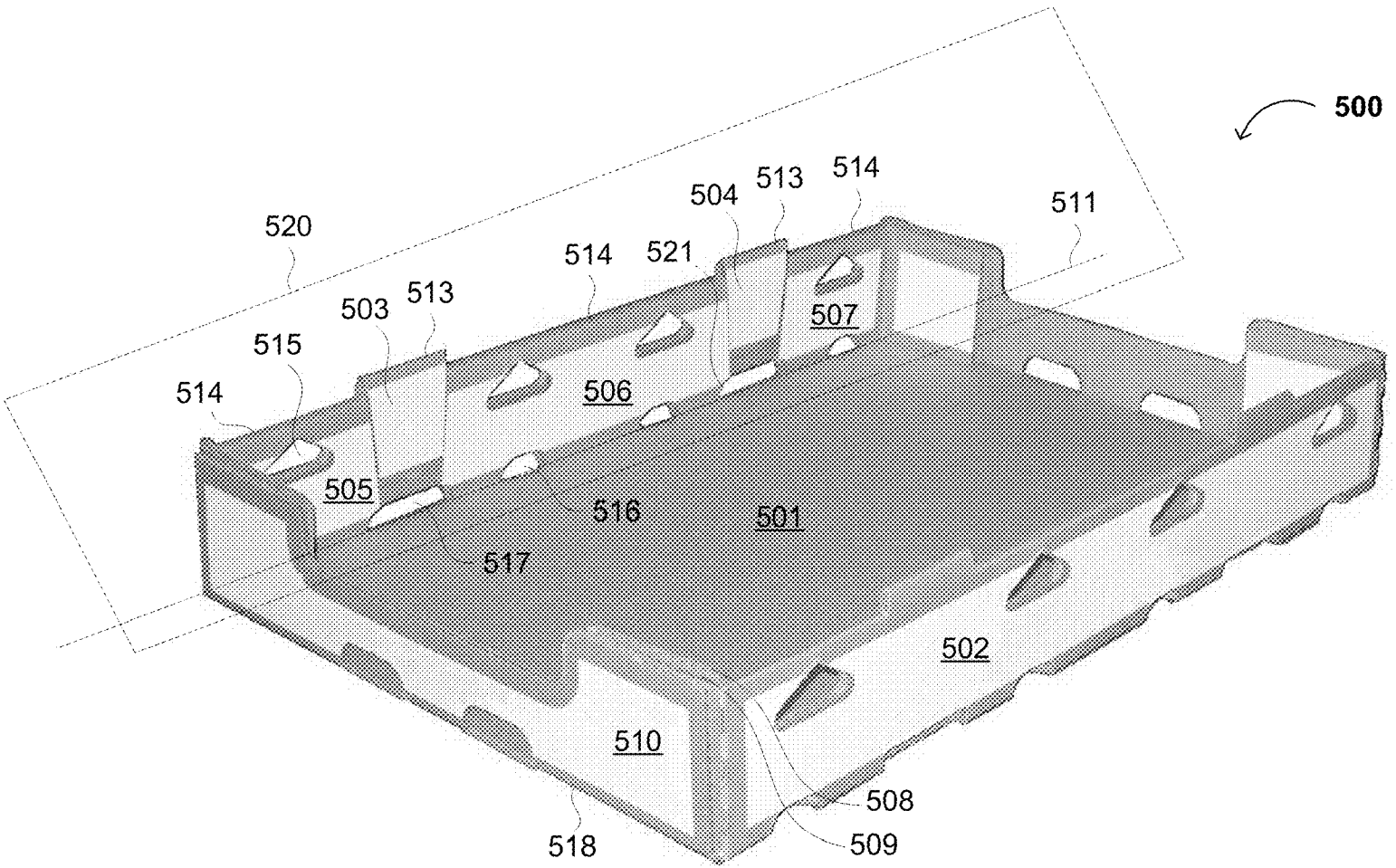
FIG. 5 is a photograph showing an implementation of a stackable container in accordance with embodiments of the present invention.

Referring now to FIG. 5, an exemplary stackable container 500 is shown. Base 501 has a first pair of opposed base edges 518 and a second pair of opposed base edges 511. First sidewall structures 510 are foldably attached to the base edges 518 at an angle of from about 90 degrees to about 100 degrees. Second sidewall structures 520 generally include a wall flap 502 foldably attached to base edge 511 at an angle of from about 90 degrees to about 100 degrees, index fold-down flaps 503 and 504 foldably attached to the wall flap 502 along fold lines 513 at an angle of about 180 degrees (e.g., folded over wall flap 502), and inner fold-down flaps 505-507 foldably attached to wall flap 502 along fold lines 514 at an angle of about 180 degrees. Sidewall structures 520 may be substantially vertical, or may be inclined at an angle of from 90 to 100 degrees (preferably an angle of from 92 to 95 degrees) to accommodate indexing functionality.

The inner fold-down flaps 505-507 and the index fold-down flaps 503 and 504 alternate such that there is an index fold-down flap between each inner fold-down flap along wall flap 502. Wall flap 502 may include one or more holes 517 configured to provide slots for indexing with another stackable container. The wall flap 502 and the index fold-down flaps 503 and 504 form index projections configured to fit into the slots 517.

Preferably, the flutes (e.g., channels in the corrugation) are vertical (or substantially vertical) in the load-bearing walls. In container 500 second sidewall structures 520 generally comprise the load-bearing wall, so the flutes of the corrugated board forming the blank should be oriented vertically in second sidewall structures 520. Thus, fold lines 513 and 514 generally cover a substantial portion of the flute tops when fold-down flaps 503-507 are folded over wall flap 502. As a result, moisture collection in the load-bearing walls (e.g., moisture due to outdoor precipitation, condensation in cold storage, and/or other natural and/or artificial events) is generally reduced.

Sidewall structure 520 may have one or more holes 515 through inner fold down flaps 505-507 and wall flap 502, configured to provide an opening for air to flow. The width at the top of the holes may be less than the width of the bottom of the holes (e.g., the holes have a generally triangular shape with an apex nearest the fold line between the wall flap and the inner fold-down flap). This triangular configuration generally provides for improved strength of the folded wall structure along fold lines 513 and 514 (e.g., as opposed to round or rectangular air holes in the same position).

The tops of the wall flaps (e.g., at the fold lines 513 of the index fold-down flaps and fold lines 514 inner fold-down flaps) are generally parallel to the fold line 511 between the second sidewall structure and the base. The tops of the wall flap at the fold lines 513 of the index fold-down flaps 503 and 504 are higher than the top of the wall flap at the fold lines 514 of the inner fold-down flaps 505-507. Thus, the index fold-down flap is folded over the wall flap to form a projection above the top of the wall flap at the fold line of the inner fold-down flaps. The heights of the inner fold-down flaps 505-507 are substantially equal to a height of the wall flap 502 (e.g., excluding the height of the projection formed by the index fold-down flap).

Each of the second sidewall structures 520 also include first extension flaps 508 foldably attached at an angle of about 90 degrees to each of the inner fold-down flaps 505 and 507 closest to the first sidewall structures 510, such that the first extension flaps 508 are parallel to the first sidewall structures. Second extension flaps 509 are foldably attached at an angle of about 90 degrees to the wall flaps 502 at ends closest to the first sidewall structures 510, such that the second extension flaps 509 are parallel to the first extension flaps 508 and to the sidewall structures 510.

Surfaces of the fold-down flaps 503-507 may be adhesively attached to a surface of the wall flap 502 (e.g., to a surface of wall flap 502 facing the inside of the container). A first surface (e.g., a surface facing away from the inside of the container) of each of the second extension flaps 509 may be adhesively attached to a surface (e.g., an inner surface) of one of the first sidewall structures 510 and a surface of each of the first extension flaps 508 may be adhesively attached to a second surface of one of the second extension flaps 509. In an alternative embodiment, a first surface of each of the second extension flaps 509 may be adhesively attached to a first surface (e.g., an outer surface) of one of the first sidewall structures 510 and a surface of each of the first extension flaps 508 may be adhesively attached to a second surface (e.g., an inner surface) of one of the first sidewall structures, thus "sandwiching" each first sidewall structure between two extension flaps.

As mentioned above, stackable container blank 300 may be substantially made from corrugated paper product material, for example. Further, when a stackable container 500 is made from blank 300, an adhesive material or glue may be used to secure different portions, flaps, and/or extensions together. For example, fold-down flaps 503-507 may be glued or otherwise adhesively attached to wall flap 502. Further, extensions 508 may be glued to extensions 509, and extensions 509 may be glued or otherwise adhesively attached to sidewall structure 510.

While the exemplary embodiment shown in FIG. 5 includes a rectangular base and particular angles and extension sizes, one skilled in the art will recognize that other base configurations (e.g., square), wall and extension angles, and wall/extension sizes may also be used in accordance with embodiments. Further, one skilled in the art will recognize that other means of attachment (e.g., besides glue) may also be used in accordance with embodiments.

Exemplary Method of Making a Stackable Container

Figure 6:
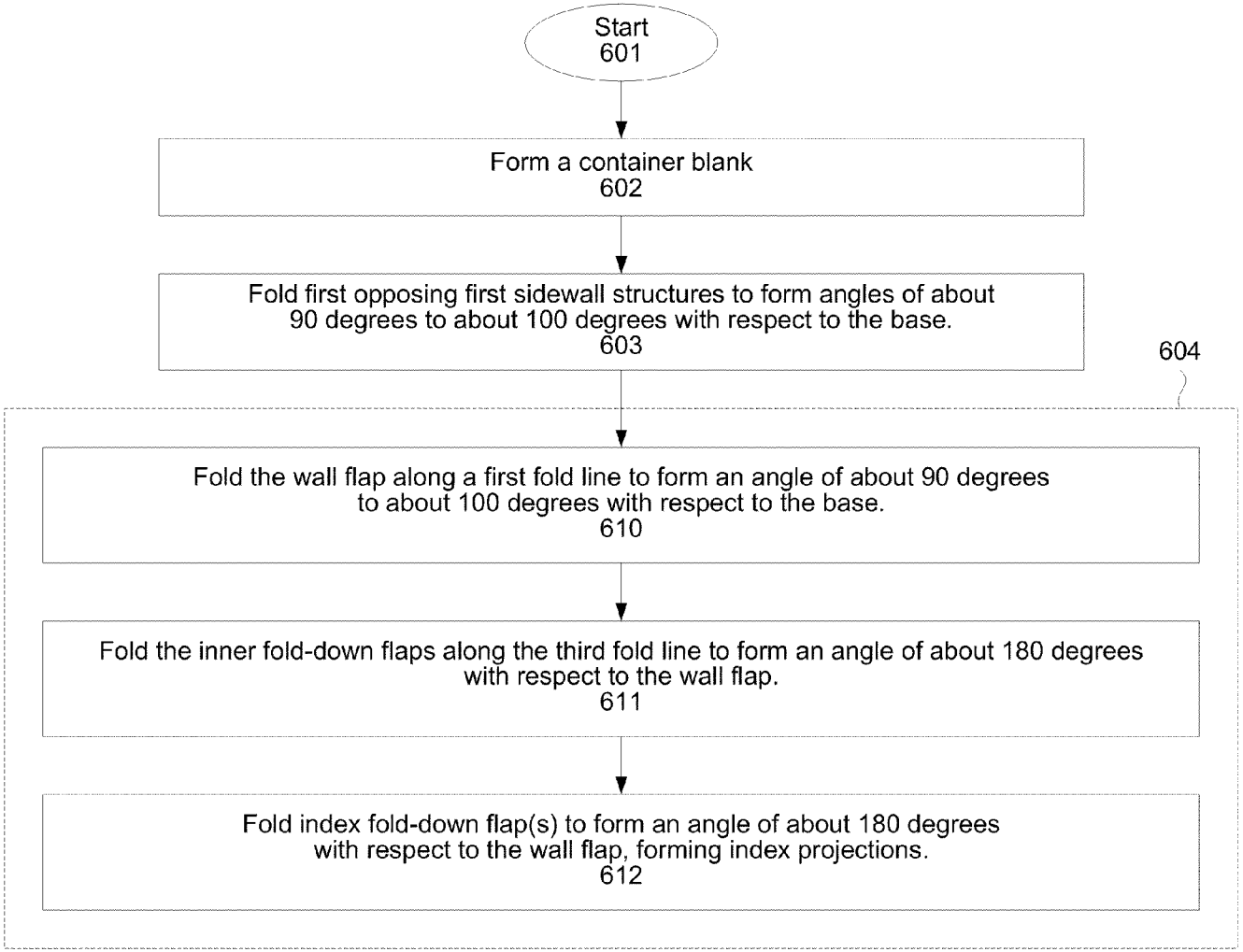
FIG. 6 is a flow diagram showing an exemplary method of making a container in accordance with an embodiment of the present invention.

Referring now to FIG. 6, a flow diagram showing an exemplary method of making a container in accordance with an embodiment of the present invention is indicated by the general reference character 600. The method begins at step 601. At step 602, a container blank (e.g., a container blank such as blank 300 of FIG. 3, blank 400 of FIG. 4, or any other stackable container blank according to the present invention) is formed. The blank generally has (a) a base having a first pair of opposed base edges (typically, but not necessarily, shorter base edges) and a second pair of opposed base edges (typically, but not necessarily, longer base edges), (b) two first sidewall structures, each first sidewall structure foldably attached to one of the first base edges, and (c) two second sidewall structures, each second sidewall structure foldably attached to one of the second base edges. Each of the second sidewall structures (e.g., structures on the longer sides) has (i) a wall flap foldably attached to one of the second base edges along a first fold line, (ii) an index fold-down flap foldably attached to the wall flap along a second fold line, and (iii) a plurality of inner fold-down flaps foldably attached to the wall flap along a third fold line, wherein the index flap and inner fold-down flaps alternate.

At step 603, two opposing first sidewall structures are folded to form angles of about 90 degrees to about 100 degrees with respect to a base of the stackable container blank. At step 604, each of the two opposing sidewall structures is folded. Step 604 includes sub-steps 610-612. At step 610, the wall flap is folded along the first fold line to form an angle of about 90 degrees to about 100 degrees with respect to the base. At step 611 the inner fold-down flaps are folded along the third fold line to form an angle of about 180 degrees with respect to the wall flap. At step 612 the index fold-down flap(s) are folded along the second fold line to form an angle of about 180 degrees with respect to the wall flap, such that the second fold line projects above the third fold line.

In a preferred embodiment, the blank has first extension flaps foldably attached to each of the inner fold-down flaps closest to the first sidewall structures and second extension flaps foldably attached to the wall flap at an edge closest to the first sidewall structures. Thus, the method may further include folding the first and second extension flaps at an angle of 90 degrees with respect to the inner fold-down flaps, such that the first and second extension flaps are approximately parallel to the first sidewall structures.

Step 604 may further include a step of adhesively attaching surfaces of each of the inner and index fold-down flaps to a surface of the wall flap. The first surface of each of the second extension flaps may be adhesively attached to a first surface of one of the first sidewall structures, and the first extension flap may be adhesively attached to a second surface of one of the second extension flaps (e.g., sandwiching each second extension flap between a first sidewall structure and a first extension flap). Alternatively, the method may include adhesively attaching a surface of each of the first extension flaps to a second surface of one of the first sidewall structures (e.g., sandwiching each second sidewall structure between first and second extension flaps).

The adhesive attaching can be done by applying an adhesive substance or glue to a surface of either of the first and second pairs of opposed walls, for example. Further, one or more of the steps of flow 600 can be performed in automated fashion. For example, a machine (e.g., a box erector) can be used to form a stackable container from a blank where the blank was made using another machine. Alternatively, a single machine may be used to form the blank (e.g., a die cutter and/or a score) and then to form the stackable container (e.g., compressor machines to push portions and/or extensions together) from the blank. As another alternative, several machines can be used to perform various portions of flow 600.

CONCLUSION

Thus, embodiments of the present invention can advantageously provide a reliable design approach for making a stackable container from a blank, whereby the weight-bearing ability and/or stackability of the container is improved, while also covering flutes on the load-bearing wall, thereby reducing moisture collection.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A stackable container blank comprising:

a) a base having a first pair of opposed base edges and a second pair of opposed base edges;

b) two first sidewall structures, each first sidewall structure foldably attached to one of said first base edges; and c) two second sidewall structures, each second sidewall structure foldably attached to one of said second base edges, wherein each of said second sidewall structures comprises:

i) a wall flap foldably attached to one of said second base edges along a first fold line, ii) at least one index fold-down flap foldably attached to said wall flap along a second fold line and configured to cover a substantial portion of a top of the wall flap when the at least one index fold-down flap is folded, and iii) a plurality of sidewall fold-down flaps, each foldably attached to said wall flap along a third fold line, wherein (A) said index fold-down flap and sidewall fold-down flaps alternate, (B) adjacent edges of said at least one index fold-down flap and said sidewall fold-down flaps are separated by a cut line, and (C) a distance between said first fold line and said second fold line is greater than the distance between said first fold line and said third fold line.

2. The stackable container blank of claim 1, wherein said wall flap comprises one or more holes configured to provide slots for indexing with another stackable container.

3. The stackable container blank of claim 2, wherein said wall flap and said index fold-down flap form an index projection configured to fit into one of said slots.

4. The stackable container blank of claim 1, wherein said wall flap and said sidewall fold-down flap each comprise one or more holes configured to provide an opening for air flow.

5. The stackable container blank of claim 1, wherein said second and third fold lines are substantially parallel to said first fold line.

6. The stackable container blank of claim 1, wherein a width of said sidewall fold-down flap is substantially equal to a width of said wall flap.

7. The stackable container blank of claim 1, wherein each of said second sidewall structures further comprises first extension flaps foldably attached to each of said sidewall fold-down flaps closest to said first sidewall structures, along first extension fold lines approximately parallel to said first base edges.

8. The stackable container blank of claim 7, wherein each of said second sidewall structures further comprises second extension flaps foldably attached to said wall flap at ends closest to said first sidewall structures, along second extension fold lines approximately parallel to said first base edges.

9. The stackable container blank of claim 8, wherein said first and second extension flaps extend beyond lines formed by said first opposing sides of said base edges.

10. The stackable container blank of claim 1, where each of said second sidewall structures comprises two of said index fold-down flaps and three of said sidewall fold-down flaps.

11. The stackable container blank of claim 1, wherein each of said second sidewall structures comprises one of said index fold-down flaps and two of said sidewall fold-down flaps.

12. A stackable container comprising:

a) a base having a first pair of opposed base edges and a second pair of opposed base edges;

b) two first sidewall structures, each first sidewall structure foldably attached to said first base edges at an angle of from about 90 degrees to about 100 degrees; and c) two second sidewall structures, wherein each of said second sidewall structures comprises:

i) a wall flap foldably attached to one of said second base edges along a first fold line at an angle of from about 90 degrees to about 100 degrees, ii) at least one index fold-down flap foldably attached to said wall flap along a second fold line at an angle of about 180 degrees and covering a substantial portion of a top of the wall flap, and iii) a plurality of sidewall fold-down flaps alternating with said index fold-down flap, said sidewall fold-down flaps foldably attached to said wall flap along a third fold line at an angle of about 180 degrees.

13. The stackable container of claim 12, further comprising a plurality of indexable slots configured to enable stacking with another stackable container.

14. The stackable container of claim 13, wherein said wall flap and said index fold-down flap form an index projection configured to fit into one of said slots.

15. The stackable container blank of claim 12, wherein said wall flap and at least one of said sidewall fold-down flaps each comprise one or more holes configured to provide an opening for air flow.

16. The stackable container of claim 12, wherein said second and third fold lines are substantially parallel to said first fold line.

17. The stackable container of claim 12, wherein a distance between said first fold line and said second fold line is greater than said distance between said first fold line and said third fold line.

18. The stackable container of claim 12, wherein a height of said sidewall fold-down flaps is substantially equal to a height of said wall flap.

19. The stackable container of claim 12, wherein a surface of one or more of said sidewall and/or index fold-down flaps is adhesively attached to a surface of said wall flap.

20. The stackable container of claim 12, wherein surfaces of each of said sidewall and index fold-down flaps are adhesively attached to a surface of said wall flap.

21. The stackable container of claim 12, wherein each of said second sidewall structures further comprises first extension flaps foldably attached at an angle of about 90 degrees to each of said sidewall fold-down flaps closest to said first sidewall structures, such that said first extension flaps are parallel to said first sidewall structures.

22. The stackable container of claim 21, wherein each of said second sidewall structures further comprises second extension flaps foldably attached at an angle of about 90 degrees to said wall flap at ends closest to said first sidewall structures, such that said second extension flaps are parallel to said first extension flaps and to said sidewall structures.

23. The stackable container of claim 22, wherein a first surface of each of said second extension flaps is adhesively attached to a first surface of one of said first sidewall structures.

24. The stackable container of claim 23, wherein a surface of each of said first extension flaps is adhesively attached to a second surface of one of said second extension flaps.

25. The stackable container of claim 23, wherein a surface of each of said first extension flaps is adhesively attached to a second surface of one of said first sidewall structures.

26. A method of making a stackable container, comprising the steps of:

a) folding two opposing first sidewall structures to form angles of about 90 degrees to about 100 degrees with respect to a base of a stackable container blank;

b) folding two opposing second sidewall structures, wherein each of said second sidewall structures comprises a wall flap foldably attached to an edge of said base along a first fold line, at least one index fold-down flap foldably attached to said wall flap along a second fold line, and a plurality of sidewall fold-down flaps foldably attached to said wall flap along a third fold line, wherein said index fold-down flap and sidewall fold-down flaps alternate along said wall flap, and wherein folding each of said two opposing second sidewall structures comprises:

i) folding said wall flap along said first fold line to form an angle of about 90 degrees to about 100 degrees with respect to said base, ii) folding said plurality of sidewall fold-down flaps along said third fold line an angle of about 180 degrees with respect to said wall flap, and iii) folding said at least one index fold-down flap along said second fold line at an angle of about 180 degrees with respect to said wall flap, such that said second fold line is above said third fold line and said at least one index fold-down flap covers a substantial portion of a top of the wall flap.

27. The method of claim 26, further comprising adhesively attaching surfaces of each of said sidewall and index fold-down flaps to a surface of said wall flap.

28. The method of claim 26, further comprising folding first extension flaps foldably attached to each of said sidewall fold-down flaps closest to said first sidewall structures at an angle of 90 degrees with respect to said sidewall fold-down flaps, such that said first extension flaps are approximately parallel to said first sidewall structures.

29. The method of claim 28, further comprising folding second extension flaps foldably attached to said wall flap at an edge closest to said first sidewall structures at an angle of 90 degrees with respect to said wall flap, such that said second extension flaps are approximately parallel to said first extension flaps and said first sidewall structures.

30. The method of claim 29, further comprising adhesively attaching a first surface of each said second extension flaps to a first surface of one of said first sidewall structures.

31. The method of claim 30, further comprising adhesively attaching a surface of each of said first extension flaps to a second surface of one of said second extension flaps.

32. The method of claim 30, further comprising adhesively attaching a surface of each of said first extension flaps to a second surface of one of said first sidewall structures.

33. The stackable container blank of claim 1, wherein said sidewall fold-down flaps are configured to cover a substantial portion of the top of the wall flap when the sidewall fold-down flaps are folded.

34. The stackable container of claim 12, wherein said sidewall fold-down flaps cover a substantial portion of the top of the wall flap.

* * * * *